US009488151B2

(12) United States Patent
Shibata et al.

(10) Patent No.: US 9,488,151 B2
(45) Date of Patent: Nov. 8, 2016

(54) IGNITION SYSTEM

(71) Applicant: DENSO CORPORATION, Kariya, Aichi-pref. (JP)

(72) Inventors: Masamichi Shibata, Toyota (JP); Atsuya Mizutani, Nagoya (JP); Koichi Hattori, Ichinomiya (JP); Yasuomi Imanaka, Obu (JP)

(73) Assignee: DENSO CORPORATION, Kariya (JP)

( * ) Notice: Subject to any disclaimer, the term of this patent is extended or adjusted under 35 U.S.C. 154(b) by 903 days.

(21) Appl. No.: 13/722,453

(22) Filed: Dec. 20, 2012

(65) Prior Publication Data

US 2013/0199510 A1 Aug. 8, 2013

(30) Foreign Application Priority Data

Feb. 8, 2012 (JP) ..... 2012-025107
Sep. 18, 2012 (JP) ..... 2012-204904

(51) Int. Cl.
*F02P 1/08* (2006.01)
*H01T 13/44* (2006.01)
(Continued)

(52) U.S. Cl.
CPC ..... *F02P 1/083* (2013.01); *F02P 3/02* (2013.01); *F02P 3/0407* (2013.01); *F02P 3/0442* (2013.01); *F02P 3/0552* (2013.01); *H01T 13/44* (2013.01)

(58) Field of Classification Search
CPC .... F02P 17/12; F02P 3/051; F02P 2017/125; F02P 3/0453; F02P 7/035; F02P 2017/128; F02P 3/045; F02P 3/02; F02P 5/1506; F02P 5/1514; F02P 5/1523; F02P 5/1526; F02P 7/07; F02P 3/0435; F02P 17/02; F02P 17/10; F02P 1/083; F02P 3/0554; F02P 5/1502; F02P 9/007; F02P 3/04; F02P 3/0442; F02P 3/0456; F02P 13/00; F02P 15/08; F02P 15/10; F02P 3/05; F02P 5/1555; F02P 9/002; F02P 3/053; F02P 3/0556; F02P 5/005; F02P 5/1455; F02P 5/151; F02P 7/021; F02P 7/03; F02P 11/02; F02P 15/00; F02P 15/12; F02P 1/00; F02P 1/08; F02P 2017/006; F02P 2017/123; F02P 3/055; F02P 3/0552; F02P 3/08; F02P 3/0884; F02P 5/00; F02P 5/1504; F02P 7/0775; Y02T 10/46; Y02T 10/26; Y02T 10/47; Y02T 10/40; Y02T 10/92; F02D 2041/285; F02D 2041/2075; F02D 2200/1015; F02D 35/027; F02D 2400/18; F02D 41/22; F02D 2041/2058; F02D 35/021; F02D 2041/141; F02D 2250/18; F02D 41/0255; F02D 41/1408; F02D 41/1482; F02D 41/2454; F02D 2041/2034; F02D 2041/2048; F02D 2041/2072; F02D 35/023; F02D 41/0052; F02D 2041/2082; F02D 2041/2089; F02D 2400/21; F02D 2400/22; F02D 31/008; F02D 41/00; F02D 41/008; F02D 41/009; F02D 41/1479; F02D 41/20; F02M 25/0752; H01F 38/12; H01F 2038/122; H01F 27/022; H01F 27/04; H01F 27/40; H01F 38/08; H01L 27/0259; H01L 29/0696; H01L 29/0834; H01L 29/7395; H01L 2224/48137; H01L 2224/48247; H01L 2224/4903; H01L 2224/49112; H01L 24/49; H01L 2924/00; H01L 2924/13055; H01L 2924/13091
USPC ..... 123/630, 634, 596; 361/57, 263
See application file for complete search history.

(56) References Cited

U.S. PATENT DOCUMENTS 3,809,043 A * 5/1974 Nagasawa ..... F02P 7/03 123/599

(Continued)

FOREIGN PATENT DOCUMENTS

JP B2-06-080313 10/1994

*Primary Examiner* — Hieu T Vo
*Assistant Examiner* — Arnold Castro
(74) *Attorney, Agent, or Firm* — Oliff PLC

(57) ABSTRACT

An ignition system is provided, in which a Zener diode is connected in parallel with a spark plug, to suppress torque variation from becoming large in an engine when deterioration of the spark plug is advanced. Specifically, the ignition system includes a secondary coil having an end connected to a center electrode of the spark plug via a connecting path. The connecting path is connected to a constant-voltage path having a grounded end and including the Zener diode. The time from when an ignition signal is switched off until when ignition timing occurs is measured for a plurality of times. The difference between a maximum value and a minimum value among the plurality of measurements is defined to be a variation range. A breakdown voltage of the Zener diode is adjusted based on requirements such as for rendering the variation range to be a predetermined time or smaller.

13 Claims, 7 Drawing Sheets

(51) Int. Cl.

| | |
|---|---|
| ***F02P 3/02*** | (2006.01) |
| ***F02P 3/055*** | (2006.01) |
| ***F02P 3/04*** | (2006.01) |

(56) References Cited

U.S. PATENT DOCUMENTS

| | | | | |
|---|---|---|---|---|
| 4,911,126 | A * | 3/1990 | Notaras | F02P 1/083 123/335 |
| 5,245,499 | A * | 9/1993 | Senes | H02H 9/04 257/E29.337 |
| 5,503,132 | A * | 4/1996 | Miyata | F02P 15/08 123/630 |
| 6,032,658 | A * | 3/2000 | Miwa | F02P 3/0435 123/655 |
| 6,539,930 | B2 * | 4/2003 | Inagaki | F02P 9/007 123/655 |
| 7,559,319 | B2 * | 7/2009 | Idogawa | F02P 3/0442 123/638 |
| 7,663,857 | B2 * | 2/2010 | Enomoto | F23Q 3/004 361/139 |
| 2002/0000809 | A1 * | 1/2002 | Karau | F02P 3/051 324/380 |
| 2002/0079900 | A1 * | 6/2002 | Inagaki | F02P 9/007 324/378 |
| 2003/0164025 | A1 * | 9/2003 | Kiess | F02P 17/12 73/35.08 |
| 2004/0084035 | A1 * | 5/2004 | Newton | F02M 26/01 123/630 |
| 2005/0134281 | A1 * | 6/2005 | Zhu | F02P 17/12 324/380 |
| 2006/0027211 | A1 * | 2/2006 | Naruse | F02P 3/05 123/406.14 |
| 2006/0027220 | A1 * | 2/2006 | Kawakita | F02P 3/0556 123/618 |
| 2006/0152865 | A1 * | 7/2006 | Nair | F02D 41/20 361/35 |
| 2006/0174858 | A1 * | 8/2006 | Kojima | F02P 3/0435 123/630 |
| 2006/0213489 | A1 * | 9/2006 | Moran | F02P 3/051 123/651 |
| 2007/0017493 | A1 * | 1/2007 | Dufour | F02P 15/08 123/638 |
| 2008/0151448 | A1 * | 6/2008 | Enomoto | H01L 27/0259 361/57 |
| 2013/0192570 | A1 * | 8/2013 | Kajita | F02P 15/00 123/596 |
| 2013/0200816 | A1 * | 8/2013 | Shibata | H01T 13/44 315/224 |
| 2014/0123967 | A1 * | 5/2014 | Shibata | F02P 15/005 123/623 |
| 2014/0252976 | A1 * | 9/2014 | Hayashi | H01T 15/00 315/219 |

* cited by examiner

COMBUSTION CHAMBER
10a
10b

COMBUSTION CHAMBER
10a
10b

COMBUSTION CHAMBER
10a
10b
γ ACTION
α ACTION

COMBUSTION CHAMBER
10a
10b
ELECTRIC FIELDS INTENSIFIED

COMBUSTION CHAMBER
10a
10b
GAS FLOW
⊖ : FREE ELECTRONS
⊕ : POSITIVE IONS
◎ : GAS MOLECULES

IGNITION SYSTEM

CROSS-REFERENCE TO RELATED APPLICATION

This application is based on and claims the benefit of priorities from earlier Japanese Patent Application Nos. 2012-025107 and 2012-204904 filed Feb. 8 and Sep. 18, 2012, respectively, the descriptions of which are incorporated herein by reference.

BACKGROUND OF THE INVENTION

1. Technical Field of the Invention

The present invention relates to an ignition system that includes a spark coil having a primary coil and a secondary coil magnetically connected to each other, a spark plug having a center electrode projected into a combustion chamber of an internal combustion engine and a ground electrode, and an ignition control means for applying a high voltage to a gap between the center electrode and the ground electrode with a current supply to the primary coil and with the subsequent cutoff of the current supply, for the production of discharge sparks in the gap.

2. Related Art

Due to the recent trend of downsizing a spark-ignition internal-combustion engine (gasoline engine) for the purposes of fuel consumption improvement and cost reduction, there is a tendency that a compression ratio is increased in the engine with the use such as of a supercharger. A high compression ratio raises an in-cylinder pressure while discharge sparks are produced in a gap between the center electrode and the ground electrode of a spark plug. Thus, the spark plug will have high discharge voltage. When the discharge voltage becomes high under the conditions where the electrodes' wear in the spark plug is advanced due to the increase of a running distance or the like, the discharge voltage may exceed an insulation-breakdown limit voltage of a plug insulator at an early stage, impairing reliability of the spark plug. As a result, discharge sparks would no longer be produced, which may lead to the occurrence of an accidental fire in the internal combustion engine.

As a measure against this, the inventors of the present invention have paid attention to a technique as disclosed in JP-B-H06-080313. The technique makes use of a constant-voltage element, such as a Zener diode or a varistor, to restrict the discharge voltage of a spark plug to within a predetermined voltage. Specifically, the spark coil has secondary-side ends, one of which is connected to the center electrode of the spark plug and to a constant-voltage element that allows a current to pass therethrough when a voltage across its terminals becomes equal to or higher than the predetermined voltage. One end of the constant-voltage element, the end being not connected to the center electrode of the spark plug, is grounded.

According to this configuration, when a voltage applied to the gap of the spark plug is about to exceed the predetermined voltage, the applied voltage is restricted by the predetermined voltage and flattened. Thus, the conditions of the gas in the gap are made suitable for discharge in a period when the applied voltage is maintained at the predetermined voltage, thereby allowing discharge sparks to occur in the gap. With this configuration, the discharge voltage of the spark plug is prevented from becoming excessively high and thus impairing the reliability of the spark plug is avoided.

The discharge voltage of a spark plug tends to become higher not only by the in-cylinder pressure but also by age-related deterioration of the spark plug. An excessively high discharge voltage due to age-related deterioration may impair reliability of the spark plug and thus may no longer allow discharge sparks to be produced in the gap. In order to eliminate such a problem, a technique has been sought for, which is able to prevent increase of discharge voltage due to age-related deterioration of a spark plug.

Specifically, in an ignition system that includes a constant-voltage element, it has been desired to achieve a configuration which helps to maintain the reliability of the spark plug due to the increase of discharge voltage, under the conditions where deterioration of the spark plug would be advanced.

SUMMARY

The present invention provides, as a typical example, an ignition system that includes: a spark coil having a primary coil and a secondary coil which are magnetically connected to each other; a spark plug having a center electrode projected into a combustion chamber of an internal combustion engine and a ground electrode; and an ignition control means that produces discharge sparks in a gap between the center electrode and the ground electrode by conducting current supply to the primary coil, followed by applying a high voltage to the gap by cutting off the current supply to the primary coil.

In the ignition system, the secondary coil has one end connected to a member having a reference potential via a low-voltage side path and the other end connected to the center electrode via the connecting path. The connecting path has an end connected to the secondary coil of the low-voltage side path or to a constant-voltage path which is grounded. The constant-voltage path is provided with a constant-voltage element that, when current supply to the primary coil is conducted, allows current supply to the constant-voltage path in a specified direction in which the polarity of an inductive voltage caused in the secondary coil turns from negative to positive, and, when the current supply to the primary coil is cut off and a voltage across the terminals of itself becomes equal to or larger than a specified voltage, allows current supply to the constant-voltage path in a direction opposite to the specified direction, while causing a voltage drop corresponding to the specified voltage. The specified voltage is adjusted to a voltage higher than a discharge voltage at the time of initial use of the spark plug (first aspect of the ignition system of the present invention).

In the typical example, the specified voltage is adjusted to a voltage higher than a discharge voltage at the time of initial use of the spark plug (when the spark plug is brand new). Accordingly, when deterioration of the spark plug is advanced to raise the discharge voltage of the spark plug, the voltage applied to the gap comes to be restricted to the voltage higher than a discharge voltage at the time of initial use of the spark plug (hereinafter referred to as "specified voltage"). Thus, the discharge voltage of the spark plug is prevented from becoming excessively high and thus the reliability of the spark plug is hardly impaired. In the typical example, the constant-voltage element may be made up of a diode that causes Zener breakdown or Avalanche breakdown when the voltage across the terminals of the constant-voltage element reaches the specified voltage (second aspect of the ignition system of the present invention).

The ignition system may preferably be configured such that the time from when current supply to the primary coil is cut off until when discharge sparks are produced in the gap is previously measured for a plurality of times, and a difference (variation range) between a minimum value and a maximum value of the plurality of measurements is set equal to or smaller than a time that is less than the maximum value and larger than the minimum value (hereinafter referred to as "predetermined time"). This is a third aspect of the ignition system of the present invention.

Usually, current supply starting timing and current supply cutoff timing with respect to the primary coil are set, in advance, being correlated to operating conditions of the internal combustion engine, so that desired combustion conditions are achieved in the internal combustion engine. When deterioration is advanced in the spark plug, a long time tends to be required from when the current supply to the primary coil is cut off until when discharge sparks are produced in the gap. When this time becomes longer, a delay time of the actual timing of producing discharge sparks will become longer with respect to the current cutoff timing set in advance. Accordingly, the combustion conditions of the internal combustion engine may be worsened. For example, there may be a concern that the torque of the internal combustion engine may be drastically varied. The concern may be eliminated by making the variation range equal to or smaller than the predetermined time. More specifically, it is preferable that the specified voltage of the constant-voltage element is ensured to be adjusted to a voltage with which the variation range becomes equal to or smaller than the predetermined time in the case where a lifetime-expired spark plug is installed in the ignition system (fourth aspect of the ignition system of the present invention).

Thus, when deterioration of the spark plug is advanced, the actual timing of producing discharge sparks is prevented from excessively delaying from appropriate timing of producing discharge sparks.

The specified voltage may be ensured to be adjusted to a voltage which achieves the variation range equal to or smaller than the predetermined time in the case where a pressure in a combustion chamber, if an internal combustion engine is used, is set to a maximum value (fifth aspect of the ignition system of the present invention).

At least either of a number of turns of the primary coil and a stray capacitance of the spark plug may preferably be configured to achieve the variation range equal to or smaller than the predetermined time in the case where a lifetime-expired spark plug is installed in the ignition system (sixth aspect of the ignition system of the present invention).

Specifically, at least either of the number of turns of the primary coil and the stray capacitance of the spark plug is configured such that, under the conditions where voltage applied to the gap is increasing after current supply to the primary coil has been cut off to achieve the variation range equal to or smaller than the predetermined time, time (rise time) will be shortened from when the voltage applied to the gap reaches a first predetermined voltage until when it reaches a second predetermined voltage which is higher than the first predetermined voltage. With this adjustment, when deterioration of the spark plug is advanced, the actual timing of producing discharge sparks is prevented from being excessively delayed from an appropriate timing of producing discharge sparks.

According to the fourth to sixth aspects set forth above, timing of producing discharge sparks can be prevented from being excessively delayed from an appropriate timing of producing discharge sparks, under the conditions where deterioration of the spark plug is advanced. Further, the combustion conditions in the internal combustion engine are hardly worsened.

Further, either of the number of turns of the primary coil and the stray capacitance of the spark plug may be configured to achieve the variation range equal to or smaller than the predetermined time in the case where a pressure in the combustion chamber, if an internal combustion engine is used, is set to a maximum value (seventh aspect of the ignition system of the present invention).

The internal combustion engine is an on-vehicle internal combustion engine. Thus, the predetermined time may preferably be set to a time that achieves torque variation of the internal combustion engine, which is equal to or smaller than a specified value in the case where a rotating speed of the internal combustion engine is maximum of the potential rotating speed of the internal combustion engine in a state where the vehicle is running (eighth aspect of the ignition system of the present invention).

DETAILED DESCRIPTION OF THE PREFERRED EMBODIMENTS

First Embodiment

With reference to the accompanying drawings, hereinafter are described some embodiments of the present invention. Referring to FIGS. 1 to 4 and FIGS. 5A and 5B first, a first embodiment of the present invention is described, in which an ignition system according to the present invention is applied to an on-vehicle spark-ignition engine.

Figure 1:
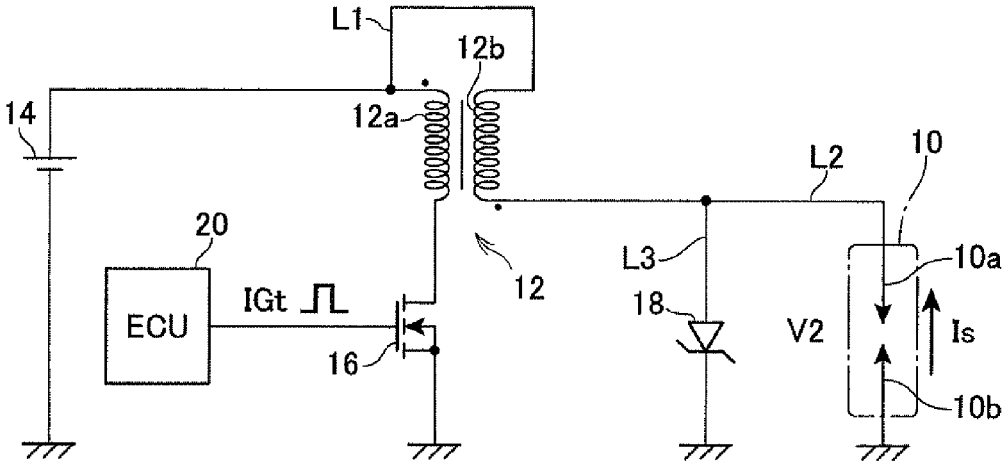
FIG. 1 is a schematic diagram generally illustrating an ignition system according to a first embodiment of the present invention.
Figure 2:
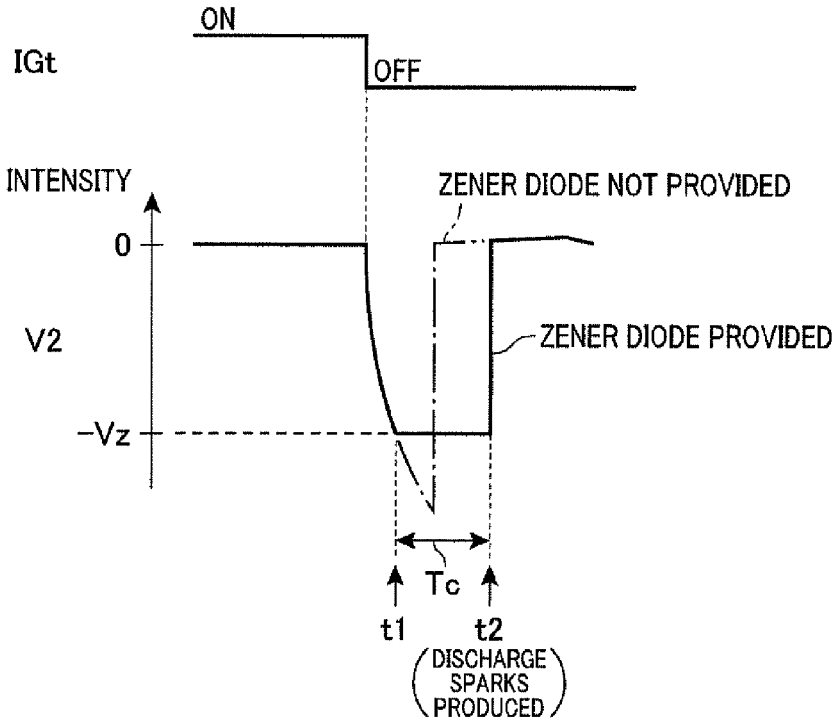
FIG. 2 is a diagram illustrating transition of secondary voltage, according to the first embodiment.

FIG. 1 is a schematic diagram generally illustrating the ignition system according to the first embodiment.

As shown in FIG. 1, the ignition system includes a spark plug 10 and a spark coil (ignition coil) 12. The spark plug 10 is composed of a center electrode 10*a* and a ground electrode 10*b* and has a function of producing discharge sparks in a combustion chamber of an engine, not shown.

The spark coil 12 is composed of a primary coil 12*a* and a secondary coil 12*b* magnetically connected to the primary coil 12*a*. The secondary coil 12*b* has ends, one of which is connected to a positive side (corresponding to a member having a reference potential) of a battery 14 via a low-voltage side path L1. The other of the ends is connected to the center electrode 10*a* via a connecting path L2. The battery 14 has a negative side which is grounded. In the present embodiment, the battery 14 is a lead battery having a terminal voltage Vb of 12 V. In the present embodiment, a grounding electric potential is 0 V.

The primary coil 12*a* has ends, one of which is connected to a positive side of the battery 14. The other of the ends of the primary coil 12*a* is grounded via an input/output terminal of a switching element 16 that is an electronically controlled opening/closing means. In the present embodiment, the switching element 16 is an N-channel MOSFET (metal oxide semiconductor field-effects transistor) having an opening/closing control terminal (gate).

The connecting path L2 is connected to a constant-voltage path L3 having a grounded end. The constant-voltage path L3 is provided with a Zener diode serving as a constant-voltage element. Specifically, the Zener diode 18 has an anode connected to the connecting path L2 and a cathode connected to a grounding portion.

An electronic control unit (hereinafter referred to as ECU 20) is mainly configured by a microcomputer to control the ignition system. The ECU 20 outputs an ignition signal IGt to the opening/closing control terminal (gate) of the switching element 16 to have the spark plug 10 produced discharge sparks.

The ECU 20 carries out ignition control. Specifically, the ECU 20 outputs an ignition signal IGt, which is an on-signal, to bring the switching element 16 into an on-state (hereinafter, this signal is referred to as "on-ignition signal IGt"). The on-ignition signal IGt is inputted to the gate of the switching element 16. This commences current supply from the battery 14 to the primary coil 12*a*, i.e., commences storage of magnetic energy in the spark coil 12. In the present embodiment, when current is supplied to the primary coil 12*a*, polarity is negative at one of the ends of the secondary coil 12*b*, which is on the center electrode 10*a*, while polarity is positive at the other of the ends, which is on the low-voltage side path L1.

After commencement of current supply to the primary coil 12*a*, the ECU 20 outputs an ignition signal IGt, which is an off-signal, to bring the switching element 16 into an off-state (hereinafter, this signal is referred to as "off-ignition signal IGt"). Then, the polarities at the ends of the secondary coil 12*b* are reversed and, at the same time, high voltage is induced to the secondary coil 12*b*. Thus, high voltage is applied to the gap between the center electrode 10*a* and the ground electrode 10*b* of the spark plug 10.

In the present embodiment, the constant-voltage path L3 is provided with the Zener diode 18. Therefore, when the voltage (secondary voltage V2) applied to the gap of the spark plug 10 is about to exceed a breakdown voltage Vz of the Zener diode 18, a voltage corresponding to the breakdown voltage Vz is dropped at the Zener diode 18. Thus, the secondary voltage V2 is restricted by the breakdown voltage Vz. Specifically, as indicated by a solid line in FIG. 2, the secondary voltage V2 is retained at the level of the breakdown voltage Vz in a period (time t1 to time t2) when the secondary voltage V2 is about to exceed the breakdown voltage Vz.

Hereinafter, the period (time t1 to time t2) when the secondary voltage V2 is retained at the level of the breakdown voltage Vz is referred to as a constant-voltage duration Tc. In other words, the constant-voltage duration Tc corresponds to the period covering from the timing when the secondary voltage has reached the breakdown voltage Vz (time t1) to the timing when discharge sparks are produced (time t2).

When the conditions of the gas in the gap become suitable for discharge in the period when the secondary voltage V2 is retained at the level of the breakdown voltage Vz, discharge sparks are produced in the gap. At the same time, a discharge current Is flows from the ground electrode 10*b* to the center electrode 10*a*. With this configuration, the discharge voltage of the spark plug 10 is prevented from becoming excessively high, unlike the discharge voltage (indicated by the dash-dot line in FIG. 2) of an ignition system including neither the Zener diode 18 nor the constant-voltage path L3.

Hereinafter is described a process of adjusting the breakdown voltage Vz of the Zener diode 18 of the present embodiment.

In the present embodiment, the breakdown voltage Vz is adjusted so that the following requirements (A) to (C) are met.

(A) The breakdown voltage Vz should be higher than the discharge voltage of a brand-new spark plug 10:

This requirement is provided to prevent the discharge voltage of the spark plug 10 from becoming excessively high due to age-related deterioration of the spark plug 10. Specifically, the discharge voltage of the spark plug 10 is low in an initial period of use. However, as the spark plug 10 is used for a longer period to increase the distance across the gap, for example, deterioration of the spark plug 10 is more advanced and thereby increases the discharge voltage.

(B) The breakdown voltage Vz should be not more than an upper-limit withstands discharge voltage (e.g., 42 kV) of the spark plug 10:

The upper-limit withstand discharge voltage is determined from a viewpoint of maintaining the reliability of the ignition system and avoiding the size of the ignition system from becoming excessively large. Specifically, the higher the induced breakdown voltage Vz is, the higher the discharge voltage becomes. Therefore, the size of the ignition system tends to be the larger accordingly in order to ensure insulation between components of the system.

Figure 3:
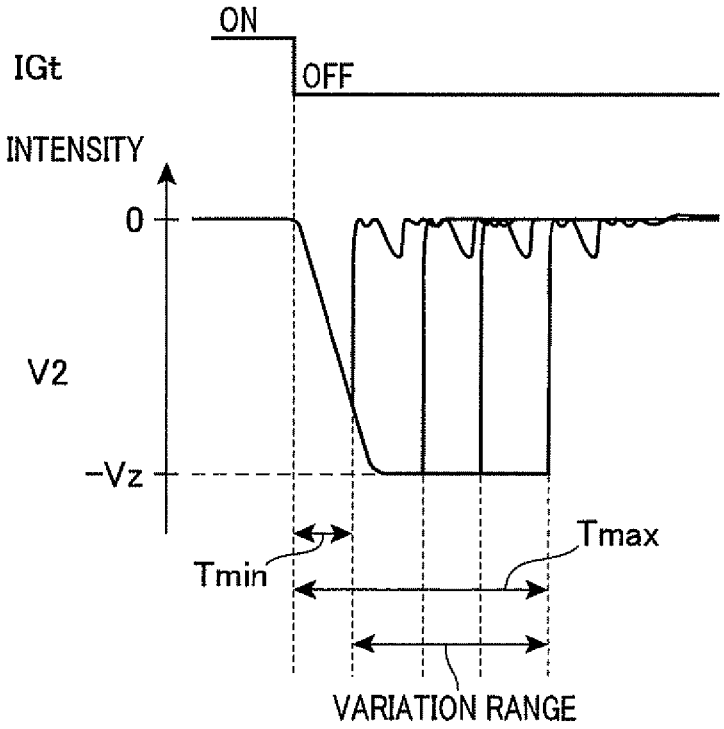
FIG. 3 is a diagram illustrating a definition of variation range, according to the first embodiment.

(C) The breakdown voltage Vz should have a variation range corresponding to a predetermined time $T_{limit}$ or smaller:

The variation range is defined as follows. As shown in FIG. 3, the time from when the on-ignition signal IGt is switched to the off-ignition signal IGt (i.e. the off-ignition signal IGt is outputted) until when discharge sparks are produced (hereinafter referred to as ignition timing) is measured for a plurality of times. Of the plurality of measured times, a minimum time Tmin and a maximum time Tmax are picked up to obtain a difference therebetween, which difference is defined to be the variation range. This requirement is provided to suppress torque variation of the engine from becoming large under the conditions where deterioration of the spark plug 10 is advanced.

Specifically, when deterioration of the spark plug 10 is advanced, discharge voltage begins to be restricted by the breakdown voltage Vz. After that, when the deterioration of the spark plug 10 is further advanced, a longer time tends to be taken from when the off-ignition signal IGt is outputted until when the ignition timing occurs. Usually, the timing when the off-ignition signal IGt is outputted is adjusted in advance being correlated to the operating conditions of the engine so that desired combustion conditions of the engine are achieved (e.g., so that output torque of the engine is maximized). Therefore, when a longer time comes to be taken from when the off-ignition signal IGt is outputted until when the ignition timing occurs, a delay time of the actual ignition timing also comes to be longer with respect to the ignition timing at the time of adjusting the ignition signal IGt. As a result, torque variation of the engine may become large. The requirement (C) is given in order to suppress the torque variation from becoming large.

Figure 4:
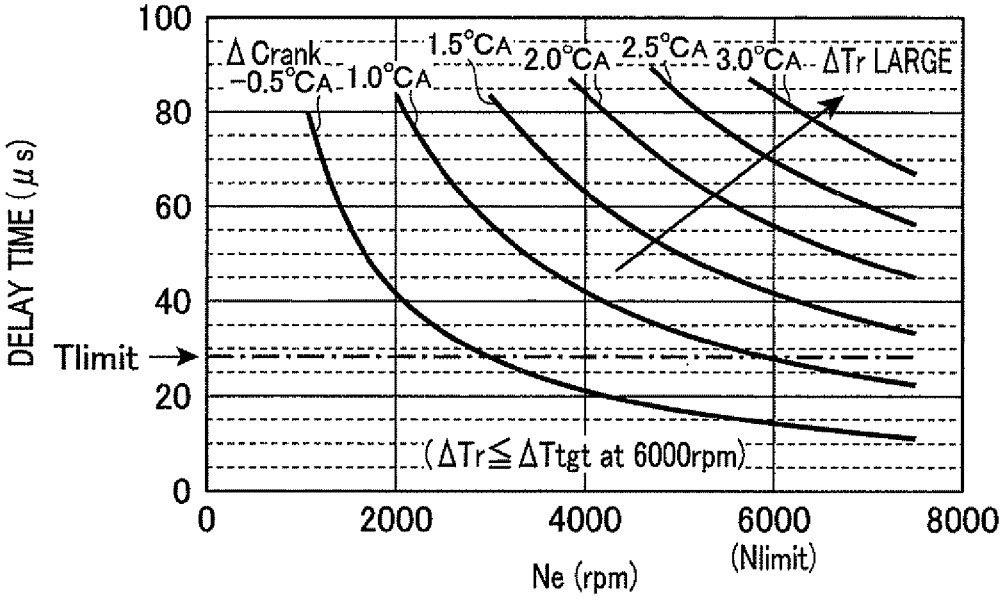
FIG. 4 is a diagram illustrating engine speed relative to delay time.

In the present embodiment, the predetermined time $T_{limit}$ is about 30 μsec. This is based on an idea of reducing a torque variation ΔTr of an engine to a specified value ΔTtgt or smaller at a supposed maximum engine speed in the vehicle's normal running (hereinafter referred to as supposed engine speed $N_{limit}$). Specifically, the delay time of the actual ignition timing with respect to the ignition timing at the time of adjusting the ignition signal IGt is converted to a rotation angle of the crank shaft of the engine and the converted value is defined to be an ignition offset angle ΔCrank. As shown in FIG. 4, as the ignition offset angle ΔCrank becomes larger, the torque variation ΔTr tends to become larger. In the present embodiment, the ignition offset angle ΔCrank is rendered to be 1° CA so that the torque variation when the supposed engine speed Nlimit is 6000 rpm will be not more than the specified value ΔTtgt. Thus, the predetermined time $T_{limit}$ in the present embodiment is about 30 μsec.

For example, the supposed engine speed $N_{limit}$ may be a maximum rotating speed (engine speed when the engine is in operation with a maximum output) or a rotating speed a little lower than the maximum rotating speed.

The specified value ΔTtgt is an allowable upper limit of the torque variation, which is determined from a viewpoint of avoiding lowering of drivability. For example, the lowering of drivability refers to that the vehicle's user is given an uneasy feeling by the increase of vibration due to torque variation or the increase of noise due to the vibration.

An upper limit that can be set as the predetermined time $T_{limit}$ becomes smaller as the breakdown voltage Vz becomes higher. This is because the magnetic energy stored in the spark coil 12 is finite, while the magnetic energy is consumed when current passes through the Zener diode 18 during the application of a voltage to the gap.

Figure 5A:
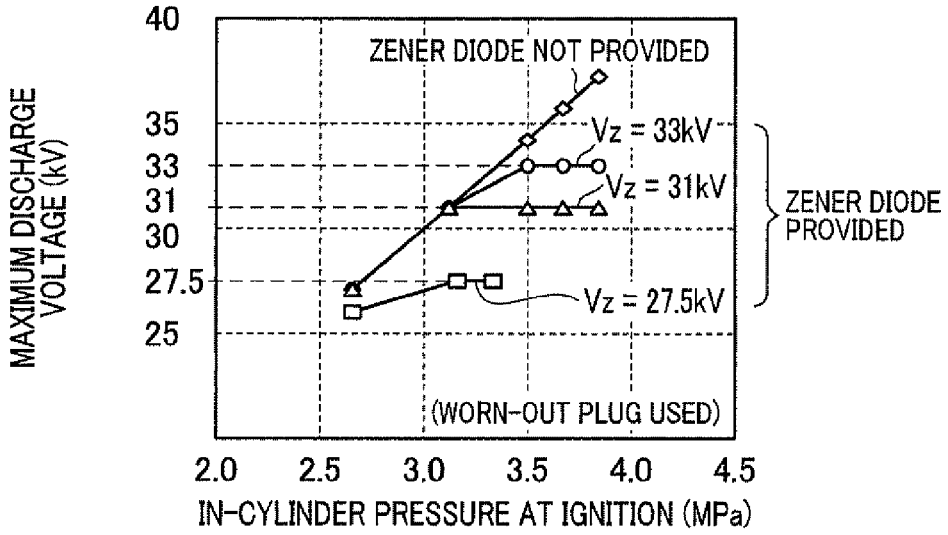
FIGS. 5A and 5B are diagrams illustrating measurements of maximum discharge voltage and variation range, respectively, with respect to pressure in a combustion chamber at ignition timing, according to the first embodiment.
Figure 5B:
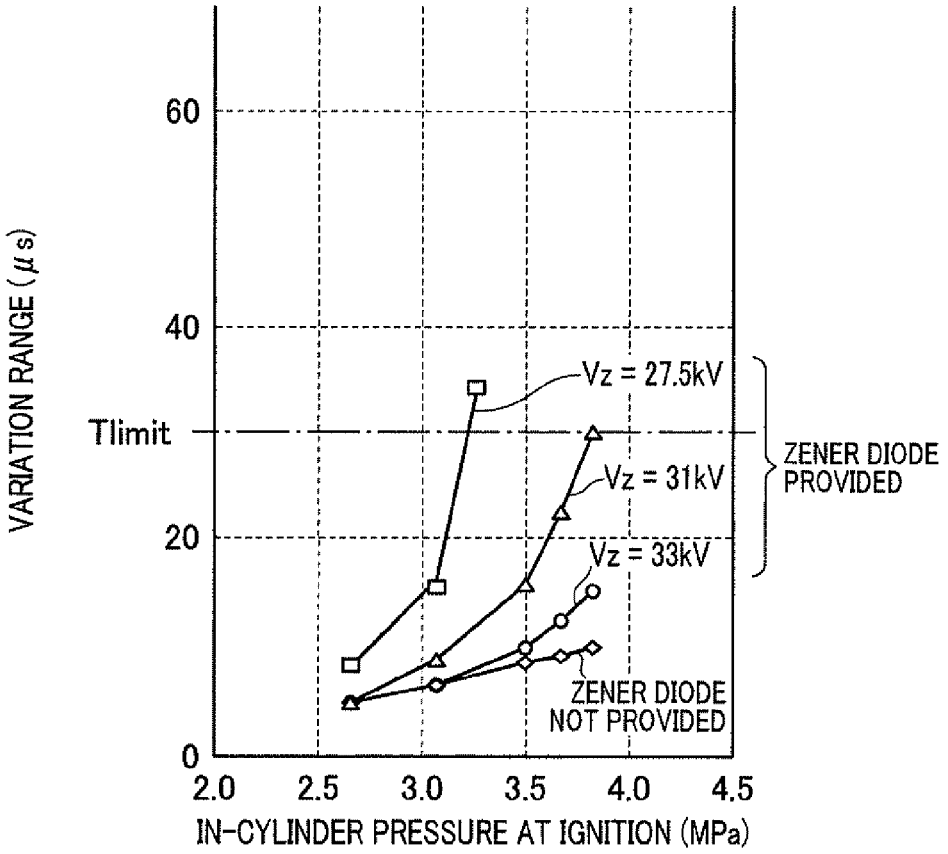

Referring to FIGS. 5A and 5B, hereinafter is specifically described the adjustment of the breakdown voltage Vz to meet the requirement (C) set forth above. FIGS. 5A and 5B show the measurements of maximum discharge voltage and variation range, respectively, in the ignition system with respect to pressure in the combustion chamber (hereinafter referred to as an in-cylinder pressure) at ignition timing. The measurements were conducted of the cases where the breakdown voltage Vz had various values (Vz=27.5 kV, 31 kV and 33 kV) and where the ignition system included neither the constant-voltage path nor the Zener diode.

An experiment conducted for the measurements is described first. The experiment was conducted under the conditions where well-known feedback control was performed to control the air-fuel ratio of the air fuel mixture supplied into the combustion chamber. Under the feedback control the air-fuel ratio is controlled to be a target air-fuel ratio. Under these conditions, the opening of the throttle valve in an intake passage which is connected to the combustion chamber was increased to increase an intake volume to thereby increase the in-cylinder pressure. Further, the ignition timing was rendered to be approximately the compression top dead center.

Further, a spark plug imitating a spark plug whose lifetime had expired (hereinafter referred to as a worn-out plug) was installed in the ignition system. The reason for using such a worn-out plug was to measure the variation range under the conditions where deterioration of the spark plug was advanced. For example, the spark plug whose lifetime has expired includes: a spark plug of a vehicle whose running distance has reached a preset maintenance distance (e.g., 100,000 km); or a spark plug whose electrode consumption (e.g., an average electrode consumption of the spark plugs of vehicles whose running distance has reached a maintenance distance) has become equal to or more than a specified amount and thus the gap distance has become equal to or larger than a predetermined distance (a spark plug having a gap distance which is larger than that of a brand-new spark plug by the specified amount or more). The maintenance distance refers to a distance indicating that the time for changing the spark plug has come to maintain the running performance of the vehicle.

The measurements are set forth below.

As shown in FIGS. 5A and 5B, a higher in-cylinder pressure at the ignition timing led to a higher maximum discharge voltage of the spark plug and a larger variation range. This is because a higher in-cylinder pressure tends to require a longer time from when high voltage is started to be applied to the gap until when the conditions of the gas in the gap become suitable for discharge.

In the case where an in-cylinder pressure at the ignition timing was equal to a maximum in-cylinder pressure (3.8 MPa) that would be reached with the use of an engine, the variation range was smaller as the breakdown voltage Vz became higher.

As a result of the measurements, the breakdown voltage Vz was adjusted to 31 kV which was the lowest among the plurality of set breakdown voltages Vz of the present embodiment. The breakdown voltage Vz of 31 kV corresponds to a voltage that achieves the variation range equal to or smaller than the specified $T_{limit}$ when the in-cylinder pressure is maximum value. The reason why the lowest voltage was selected was to suppress the increase in the size of the ignition system as much as possible.

When the breakdown voltage Vz was rendered to be 31 kV, the maximum discharge voltage in an ignition system having a Zener diode was reduced by about 18% compared to the maximum discharge voltage in an ignition system having neither a Zener diode nor a constant-voltage path.

Thus, in the present embodiment, the breakdown voltage Vz of the Zener diode 18 was adjusted in a manner described above. In this way, under the conditions where deterioration of the spark plug 10 is advanced, the increase of torque variation of the engine due to the delay of ignition timing can be preferably suppressed.

Second Embodiment

Referring now to FIGS. 6A to 6E and FIGS. 7 to 10, hereinafter is described an ignition system according to a second embodiment of the present invention focusing on differences from the first embodiment. In the second embodiment, the components identical with or similar to those in the first embodiment are given the same reference numerals for the sake of omitting unnecessary explanation.

The ignition system according to the second embodiment is different from the first embodiment in the configuration for achieving the variation range equal to or smaller than the predetermined time $T_{limit}$. Specifically, the ignition system is configured to shorten a rise time so that the variation range is rendered to be the predetermined time $T_{limit}$ or smaller. In the present embodiment, the rise time refers to a time from when the secondary voltage V2 has reached a first predetermined voltage Vf1 until when it reaches a second predetermined voltage Vf2, under the conditions where the on-ignition signal IGt is switched to the off-ignition signal IGt to increase the secondary voltage V2. Hereinafter is described how and why the above configuration has been employed to the present embodiment.

Figures 6A, 6B, 6C, 6D, 6E:
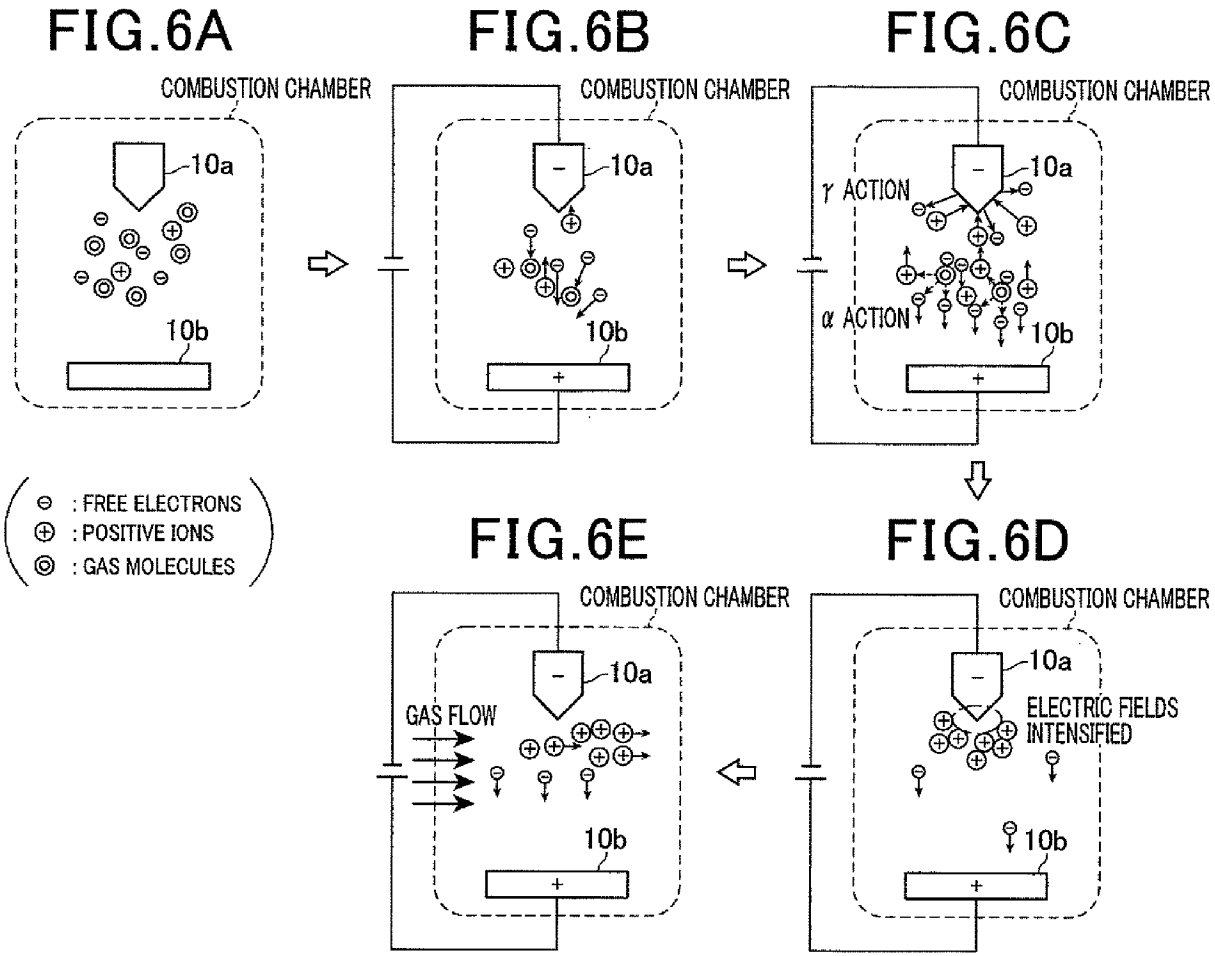
FIGS. 6A to 6E are diagrams illustrating influences of a gas flow on the conditions of the gas in a gap, according to a second embodiment of the present invention.

FIGS. 6A to 6E show transition of the conditions of the gas in the gap. Specifically, FIG. 6A shows the conditions of the gas in the gap before being applied with a high voltage. FIGS. 6B to 6E show the conditions of the gas in the gap being applied with a high voltage.

As shown in FIG. 6A, free electrons are present in the gap. Upon application of a high voltage to the gap, the free electrons in the gap are accelerated by electric fields, as shown in FIG. 6B, for collision with gas molecules. Accordingly, as shown in FIG. 6C, free electrons are emitted from the gas molecules to form positive ions (α action). The positive ions formed in this way collide with the center electrode 10*a*, allowing the center electrode 10*a* to emit free electrons (γ action).

In the structure of a generally used spark plug, the center electrode 10*a* functions as a needle electrode and the ground electrode 10*b* functions as a plate electrode. Therefore, electric fields are concentrated in a space near the center electrode 10*a*. Thus, as shown in FIG. 6D, the free electrons are accelerated and move toward the ground electrode 10*b*. At the same time, the density of the positive ions becomes high near the center electrode 10*a*. The high density of the positive ions near the center electrode 10*a* intensifies the electric fields near the center electrode 10*a*. As a result, the α action is accelerated to thereby produce discharge sparks in the gap.

As shown in FIG. 6E, a flow of air fuel mixture (hereinafter is referred to as a gas flow) is caused in a period from when a high voltage is applied to the gap until when discharge sparks are produced. When the gas flow is caused, the positive ions near the center electrode 10*a* are flowed out of a space in the vicinity of the gap. With the flow of the positive ions, the electric fields near the center electrode 10*a* are weakened, which weakening is considered to increase the variation range. In the present embodiment, the ignition system is configured to include the Zener diode 18 to prevent discharge voltage from becoming excessively high. For this reason, the time from when a voltage is applied to the gap until when discharge sparks are produced could be prominently lengthened. Accordingly, the positive ions near the center electrode 10*a* are easily disturbed by the gas flow and thus the variation range may be prominently enlarged. As mentioned above, a large variation range is likely to accelerate torque variation of the engine.

In order to take measures against this problem, the inventors of the present invention have conducted research and experiment, seeking for a technique of reducing the influences of the gas flow on the variation range. As a result of the research and experiment, the inventors have found that, if the gas flow is caused in the gap, its influences on the variation range are reduced by producing a large amount of positive ions before positive ions are disturbed by the gas flow. Thus, the inventors have obtained a finding that a shortened rise time can produce a large amount of positive ions.

Thus, in configuring the ignition system of the present embodiment, the inventors have employed a technique of shortening the rise time to achieve the variation range equal to or smaller than the predetermined time $T_{limit}$.

Figure 7:
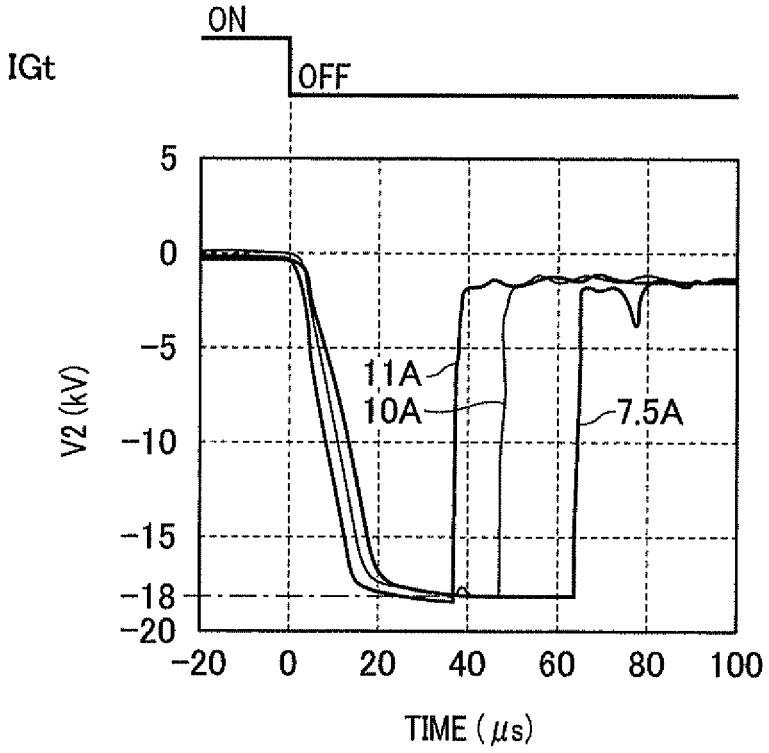
FIG. 7 is a diagram illustrating rise times relative to transition of secondary voltage, according to the second embodiment.
Figure 8:
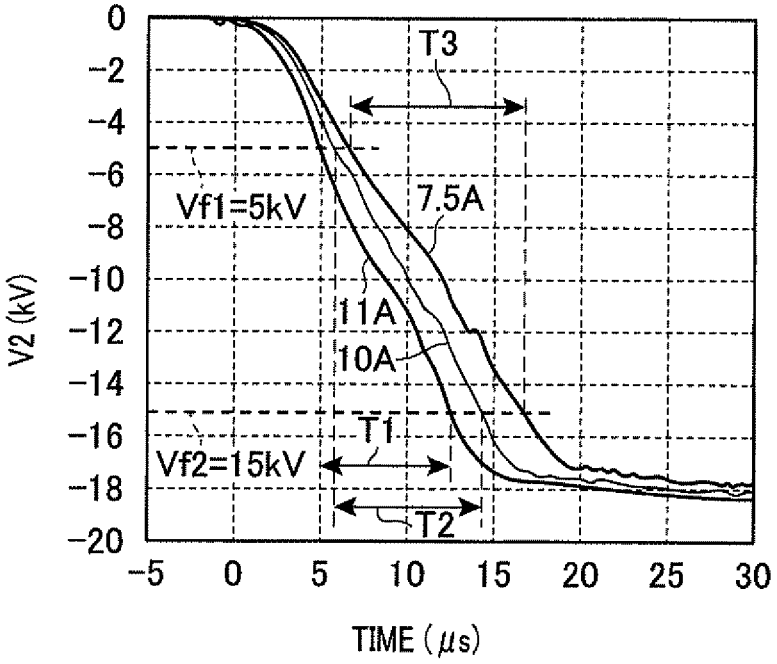
FIG. 8 is a diagram illustrating rise times relative to transition of secondary voltage, according to the second embodiment.
Figure 9:
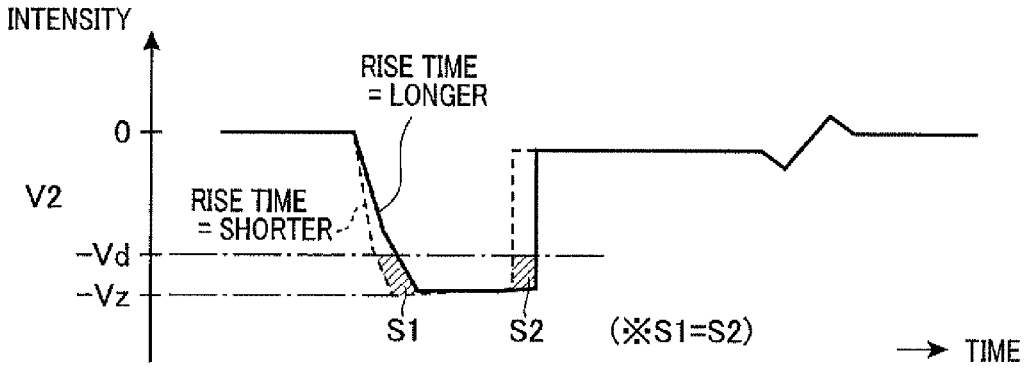
FIG. 9 is a diagram illustrating rise time relative to transition of secondary voltage, according to the second embodiment.

Referring to FIGS. 7 to 9, hereinafter are further described the influences of the rise time on the variation range. Specifically, FIGS. 7 and 8 each show transition of the secondary voltage V2 with respect to three rise times. FIG. 8 is an enlarged view of FIG. 7 in respect of the time scale. It should be appreciated that FIGS. 7 and 8 show measurements in the case where the breakdown voltage Vz of the Zener diode 18 is set to 18 kV. Further, in the present embodiment, the first predetermined voltage Vf1 is set to 5 kV, while the second predetermined voltage Vf2 is set to 15 kV. In addition, the rise time in the present embodiment is shortened by increasing current passed through the primary coil 12*a* with the change of the terminal voltage of the battery 14.

As shown in FIGS. 7 and 8, there is a tendency that a shorter rise time can more shorten the time from when the off-ignition signal IGt is outputted until when ignition timing occurs. As a result, the variation range tends to become smaller. FIG. 8 shows the three rise times designated by T1, T2 and T3 (T1<T2<T3).

Referring to FIG. 9, hereinafter are described the reasons why the variation range becomes small when the rise time is shortened. In FIG. 9, reference Vd indicates a discharge voltage when a DC voltage is applied to the gap (hereinafter referred to as DC discharge voltage).

An area enclosed by the secondary voltage V2 of not less than the DC discharge voltage Vd and the DC discharge voltage Vd correlates to the energy required for the production of discharge sparks. The area is substantially constant irrespective of the rise time. Accordingly, a shorter rise time leads to earlier timing at which the secondary voltage V2 exceeds the DC discharge voltage Vd. Thus, the required energy is produced at an earlier stage on the secondary coil 12*b*. In this way, a large amount of positive ions is produced near the center electrode 10*a* at an earlier stage after the ignition signal IGt has been switched off, thereby producing discharge sparks in a stable manner. This resultantly shortens the time from when the off-ignition signal IGt is outputted until when the ignition timing occurs and thus the variation range becomes small.

The required energy mentioned above is substantially constant irrespective of the rise time. Therefore, areas S1 and S2 shaded in FIG. 9 are equal to each other.

Figure 10:
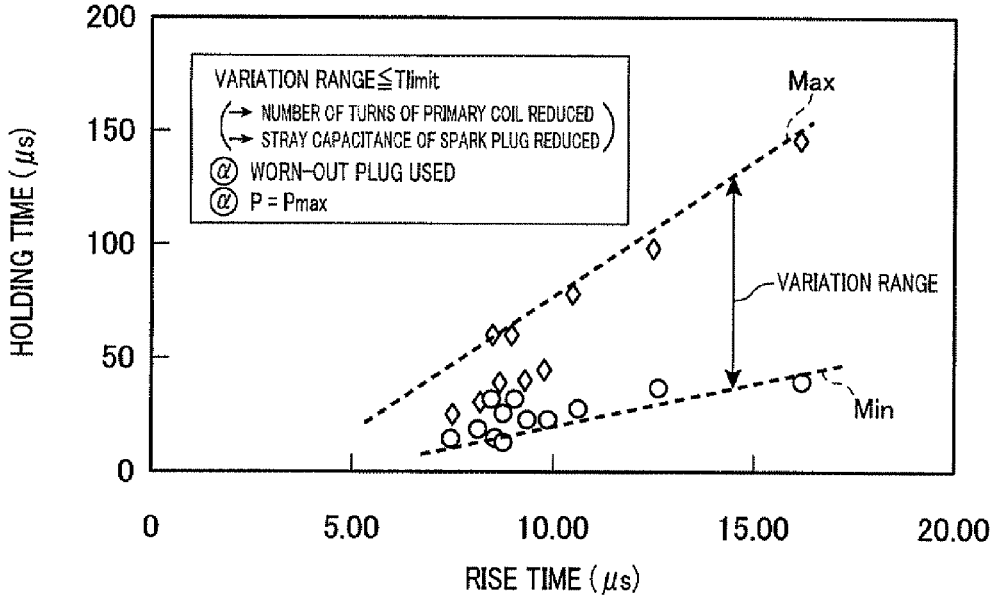
FIG. 10 is a diagram illustrating rise time relative to holding time, according to the second embodiment.

FIG. 10 shows measurements of holding time with respect to varying rise time. The holding time here refers to a time from when the secondary voltage V2 has reached the breakdown voltage Vz until when the ignition timing occurs. FIG. 10 shows measurements in the case where the breakdown voltage Vz is set to 18 kV. FIG. 10 shows both of a maximum-value line and a minimum-value line. The maximum-value line is based on maximum values (indicated by a symbol ◇ in the figure) of several holding times. The minimum-value line is based on minimum values (indicated by a symbol ○ in the figure) of several holding times. The difference between these lines corresponds to the variation range.

As shown in FIG. 10, as the rise time is shorter, the holding time tends to be shorter and, resultantly, the variation range is smaller.

The present embodiment is premised on that the breakdown voltage Vz of the Zener diode 18 is adjusted, meeting the requirements (A) and (B) explained in the first embodiment. On this premise, a number of turns N1 of the primary coil 12*a* and a stray capacitance Cp of the spark plug 10 have been adjusted, in the present embodiment, so that the variation range will be equal to the predetermined time $T_{limit}$ or smaller.

Specifically, the number of turns N1 of the primary coil 12*a* has been reduced compared to the number of turns in an ignition system based on conventional art. When the number of turns N1 of the primary coil 12*a* is reduced, inductance of the primary coil 12*a* is reduced to thereby increase primary current in a period in which the on-ignition signal IGt is outputted. Accordingly, the magnetic energy stored in the spark coil 12 is increased and the rise time is shortened.

Further, an insulator has been permitted to have a thickness which is larger than in an ignition system of conventional art. The insulator is a member that configures the spark plug 10 and insulates between the housing and the center electrode 10*a* both of which also configure the spark plug 10. The stray capacitance Cp is ensured to be reduced with this configuration. As the stray capacitance Cp of the spark plug 10 is reduced, a high voltage is more promptly applied to the gap to thereby shorten the rise time.

In adjusting the number of turns N1 of the primary coil 12*a* and the stray capacitance Cp of the spark plug 10 in the present embodiment, the experimental conditions have been set as follows. Specifically, the ignition system has been equipped with a worn-out plug. Also, an in-cylinder pressure P at the ignition timing has been set to a maximum in-cylinder pressure Pmax (3.8 MPa) that can be exhibited when an engine is used.

The rise time for achieving the variation range equal to or smaller than the predetermined time $T_{limit}$ depends on the breakdown voltage Vz set to the Zener diode 18. Accordingly, the number of turns N1 and the stray capacitance Cp are adjusted according to the breakdown voltage Vz.

In FIG. 10, when the rise time is asymptotically zero, the holding time is considered not to necessarily become zero but to converge on a predetermined value larger than zero (e.g., about 3 μsec). This is because, in performing discharge, there is time required for free electrons to be generated in the gap (statistical delay time).

With the adjusting process described above as well, the torque variation of an engine is preferably suppressed from being increased due to the delay of ignition timing.

(Modifications)

The embodiments described above may be implemented with the modifications as set forth below.

In the embodiments described above, the circuit configuration of the ignition system is not limited to the one shown in FIG. 1. For example, of the two ends of the low-voltage side path L1, the end opposite to the secondary coil 12*b* may be connected (grounded) to the grounding portion (corresponding to a member having a reference potential) to provide the circuit configuration.

Figure 11:
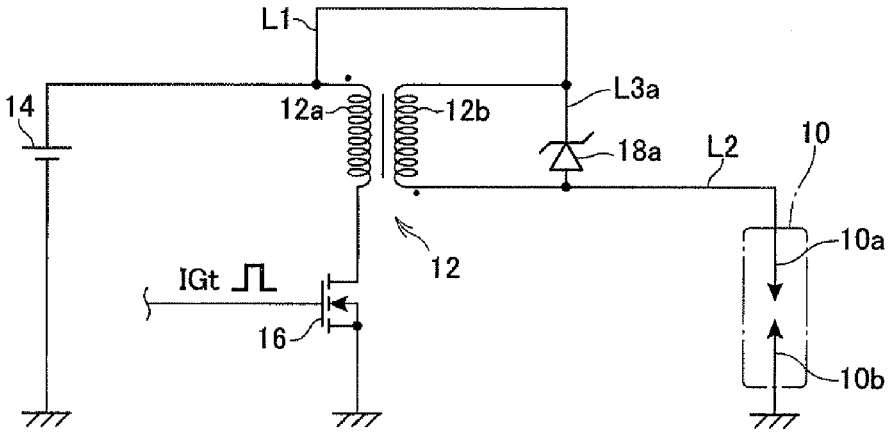
FIG. 11 is a schematic diagram generally illustrating an ignition system according to a modification of the present invention.

Alternatively, in the circuit configuration, the secondary coil 12*b* of the low-voltage side path L1 may be connected, as shown in FIG. 11, to the connecting path L2 via a constant-voltage path L3*a*, with a Zener diode 18*a* being arranged in the constant-voltage path L3*a*. Specifically, in this case, the anode of the Zener diode 18*a* is connected to the connecting path L2, while the cathode thereof is connected to the Low-voltage side path L1.

In the above circuit configuration, when the on-ignition signal IGt is switched to the off-ignition signal IGt and when an inductive voltage of the secondary coil 12*b* is about to exceed the breakdown voltage Vz of the Zener diode 18*a*, the inductive voltage is restricted by the breakdown voltage Vz. In other words, the voltage applied to the gap is retained to the level of the breakdown voltage Vz.

In the circuit configuration of the ignition system in the first embodiment described above, the center electrode of the spark plug serves as a negative electrode and the ground electrode thereof serves as a positive electrode. This circuit configuration ensures the occurrence of what is called "negative discharge" in which discharge current flows from the ground electrode to the center electrode when the off-ignition signal IGt is outputted. However, the circuit configuration is not limited to this. For example, the circuit configuration may be such that the center electrode serves as a positive electrode and the ground electrode serves as a negative electrode. With this configuration, what is called "positive discharge" may be ensured to occur, in which discharge current flows from the center electrode to the ground electrode when the off-ignition signal IGt is outputted.

The process of setting the predetermined time $T_{limit}$ is not limited to the one exemplified in the above embodiments. A long delay time of the actual ignition timing with respect to the ignition timing at the time of adjustment is likely to increase emission of smoke from the combustion chamber into an exhaust path. Therefore, for example, the predetermined time $T_{limit}$ may be set to a time (period) with which the amount of increase of smoke with reference to the time point of the adjustment will be not more than a specified amount. Also, when the delay time becomes long, the output torque of the engine is likely to decrease. Therefore, for example, the predetermined time $T_{limit}$ may be set to a time (period) with which the amount of decrease of the output torque of the engine with reference to the time point of the adjustment will be not more than a specified torque.

In the first embodiment, the requirements (A) to (C) are given as requirements for adjusting the breakdown voltage Vz of the Zener diode. In addition to these requirements (A) to (C), another requirement may be added, which is associated with ambient temperature of the vehicle (engine). When the ambient temperature lowers, the constant-voltage duration tends to be long. Thus, according to this additional requirement, the breakdown voltage Vz of the Zener diode may be set to a larger value as the ambient temperature is set to a smaller value, in order to prevent excessive delay of the ignition timing.

Alternatively, the requirement (A) alone may be selected as a requirement for adjusting the breakdown voltage Vz. In this case as well, the discharge voltage of the spark plug 10 is prevented from becoming excessively high due to age-related deterioration of the spark plug 10.

Of the components of the ignition system, objects to be adjusted for achieving the variation range equal to or smaller than the predetermined time $T_{limit}$ are not limited to the ones (the primary coil 12*a* and the spark plug 10) exemplified in the second embodiment. For example, the object to be adjusted may be either one of the primary coil 12*a* and the spark plug 10. When the object to be adjusted is only the spark plug 10, the variation range corresponding to the predetermined time $T_{limit}$ or smaller is achieved by adjusting the stray capacitance Cp of the spark plug 10. Thus, for example, constraints that would be imposed in designing an ignition system are expected to be drastically reduced.

Further, components subjected to adjustment are not limited to the primary coil 12*a* and the spark plug 10. For example, the Zener diode 18 may be the component subjected to adjustment. In this case, in order to achieve the variation range corresponding to the predetermined time $T_{limit}$ or smaller, the stray capacitance of the Zener diode 18 is reduced compared with the stray capacitance in an ignition system of conventional art. Specifically, for example, the stray capacitance may be reduced by arranging the Zener diode 18 so that the high-voltage terminal (anode) thereof is well distanced from the grounding portion. Further, for example, the stray capacitance may be reduced by providing the Zener diode 18 with an insulating member that has a low specific permittivity to insulate the Zener diode 18 from the surroundings, or by reducing an area in the surface of the chip of the Zener diode 18, which area faces the grounding portion.

For example, the specific permittivity may be reduced by changing the material used for the insulating member. The materials having low permittivity include silicon resins (specific permittivity: 3.5 to 5), silicon rubbers (specific permittivity: 3 to 3.5), epoxy resins (specific permittivity: 4 to 5) and fluorine resins (specific permittivity: 4 to 8).

Further, the component subjected to adjustment may be the connecting path L2. In this case, the stray capacitance residing between the connecting path L2 and the grounding portion may be reduced compared to the stray capacitance in an ignition system of conventional art. Specifically, for example, the stray capacitance may be reduced by locating the connecting path L2 so as to be well distanced from the grounding portion with no inclusions therebetween, or by reducing the length of the connecting path L2. Further, for example, the stray capacitance may be reduced by arranging an insulating layer in the connecting path L2 for the insulation of the connecting path L2 from the surroundings. Specifically, in this case, the stray capacitance is reduced by increasing the thickness of the insulating layer or reducing specific permittivity of the insulating layer. As mentioned above, the specific permittivity may be reduced, for example, by changing the material of the insulating layer.

The rise time does not necessarily have to be defined in a manner as exemplified in the second embodiment. The first and second predetermined voltages Vf1 and Vf2 may be set to any levels that fall within a range of from "0 V" inclusive to the breakdown voltage Vz inclusive of the Zener diode 18.

The constant-voltage element is not limited to the one exemplified in the embodiments described above. For example, the constant-voltage element may be an Avalanche diode that causes Avalanche breakdown when the voltage across the terminals of itself becomes equal to a voltage higher than a discharge voltage at the time of initial use of the spark plug. Alternatively, the constant-voltage element may be an element other than the Zener diode or the Avalanche diode if the element has functions similar to these diodes.

What is claimed is:

1. An ignition system comprising:

a spark coil having a primary coil and a secondary coil which are magnetically connected to each other;

a spark plug having a center electrode and a ground electrode, both electrodes being projected into a combustion chamber of an internal combustion engine and forming a gap between both of the electrode; and an ignition control means that produces discharge sparks in the gap between the center electrode and the ground electrode by conducting current supply to the primary coil and then cutting off the current supply to the primary coil such that a high voltage is applied across the gap;

wherein the secondary coil has two ends, one of the two ends being electrically connected to, via a low-voltage side path, a member having a reference potential, and the other end being electrically connected, via a connecting path, to the center electrode;

the ignition system includes a constant-voltage path having two ends, the connecting path is electrically connected to one of the two ends of the constant-voltage path, the other end of the two ends of the constant-voltage path being electrically connected to either the ground or the one end of the secondary coil;

the ignition system is provided with a constant-voltage element arranged in the constant-voltage path such that, when current is supplied to the primary coil, the constant voltage element allows current supply to the constant-voltage path in a specified direction in which the polarity of an inductive voltage caused in the secondary coil turns from negative to positive, and, when the current supply to the primary coil is cut off and a voltage across the terminals of the constant-voltage element becomes equal to or larger than a specified voltage, the constant-voltage element allows current supply to the constant-voltage path in a direction opposite to the specified direction, while causing a voltage drop corresponding to the specified voltage across the constant-voltage element; and the specified voltage is selected to a voltage higher than a discharge voltage provided by a spark plug which has not yet been used.

2. The ignition system according to claim 1, wherein the constant-voltage element is made up of a diode that causes Zener breakdown or Avalanche breakdown when the voltage across the terminals of the constant-voltage element reaches the specified voltage.

3. The ignition system according to claim 2, wherein a time instant from when current supply to the primary coil is cut off until when discharge sparks are produced in the gap is previously measured for a plurality of times, and a difference between a minimum value and a maximum value of the plurality of measurements is set to be equal to or smaller than a predetermined time that is less than the maximum value and larger than the minimum value, the difference being referred to as a variation range.

4. The ignition system according to claim 3, wherein the specified voltage of the constant-voltage element is ensured to be selected to a voltage with which the variation range becomes equal to or smaller than the predetermined time in the case where a lifetime-expired spark plug is installed in the ignition system.

5. The ignition system according to claim 4, wherein the specified voltage is ensured to be selected to a voltage which achieves the variation range equal to or smaller than the predetermined time in the case where a pressure in a combustion chamber is set to a maximum value.

6. The ignition system according to claim 3, wherein at least either of a number of turns of the primary coil and a stray capacitance of the spark plug is configured to achieve the variation range equal to or smaller than the predetermined time in the case where a lifetime-expired spark plug is installed in the ignition system.

7. The ignition system according to claim 6, wherein either of the number of turns of the primary coil and the stray capacitance of the spark plug is configured to achieve the variation range equal to or smaller than the predetermined time in the case where a pressure in the combustion chamber is set to a maximum value.

8. The ignition system according to claim 7, wherein the internal combustion engine is an on-vehicle internal combustion engine, and the predetermined time is set to a time that achieves torque variation of the internal combustion engine, which is equal to or smaller than a specified value in the case where a rotating speed of the internal combustion engine is a maximum potential rotating speed of the internal combustion engine in a state where the vehicle is running.

9. The ignition system according to claim 1, wherein the time from when current supply to the primary coil is cut off until when discharge sparks are produced in the gap is previously measured for a plurality of times, and a difference between a minimum value and a maximum value of the plurality of measurements is set to be equal to or smaller than a predetermined time that is less than the maximum value and larger than the minimum value, the difference being referred to as a variation range.

10. The ignition system according to claim 9, wherein the internal combustion engine is an on-vehicle internal combustion engine, and the predetermined time is set to a time that achieves torque variation of the internal combustion engine, which is equal to or smaller than a specified value in the case where a rotating speed of the internal combustion engine is a maximum potential rotating speed of the internal combustion engine in a state where the vehicle is running.

11. The ignition system according to claim 4, wherein the internal combustion engine is an on-vehicle internal combustion engine, and the predetermined time is set to a time that achieves torque variation of the internal combustion engine, which is equal to or smaller than a specified value in the case where a rotating speed of the internal combustion engine is a maximum potential rotating speed of the internal combustion engine in a state where the vehicle is running.

12. The ignition system according to claim 5, wherein the internal combustion engine is an on-vehicle internal combustion engine, and the predetermined time is set to a time that achieves torque variation of the internal combustion engine, which is equal to or smaller than a specified value in the case where a rotating speed of the internal combustion engine is a maximum potential rotating speed of the internal combustion engine in a state where the vehicle is running.

13. The ignition system according to claim 6, wherein the internal combustion engine is an on-vehicle internal combustion engine, and the predetermined time is set to a time that achieves torque variation of the internal combustion engine, which is equal to or smaller than a specified value in the case where a rotating speed of the internal combustion engine is a maximum potential rotating speed of the internal combustion engine in a state where the vehicle is running.

* * * * *